United States Patent [19]

McLean

[11] 3,995,366

[45] Dec. 7, 1976

[54] PUSH BUTTON OPERATED CAN OPENER

[75] Inventor: Robert E. McLean, Raytown, Mo.

[73] Assignee: Rival Manufacturing Company, Kansas City, Mo.

[22] Filed: Jan. 19, 1976

[21] Appl. No.: 650,500

[52] U.S. Cl. ..... 30/4 R
[51] Int. Cl.[2] ..... B67B 7/38
[58] Field of Search ..... 30/4 R, 8, 8.5, 9

[56] References Cited

UNITED STATES PATENTS

| | | | |
|---|---|---|---|
| 3,528,175 | 9/1970 | Rich | 30/4 R |
| 3,611,565 | 10/1971 | McLean | 30/4 R |
| 3,736,659 | 6/1973 | McLean | 30/4 R |

*Primary Examiner*—Gary L. Smith
*Attorney, Agent, or Firm*—Lowe, Kokjer, Kircher, Wharton & Bowman

[57] ABSTRACT

A power operated can opener includes a feed wheel that is driven by a shaft carried on a pivotal yoke, with the shaft being driven by an electric motor through reduction gearing. A pawl is pivoted to a rock plate which is in turn pivoted to a spring loaded lever mounted on the can opener frame. The pawl is operated by a pair of push buttons and associated linkage which energizes the motor as the pawl is pivoted against the feed wheel shaft. Orbiting pins carried outboard of the shaft axis are engaged by the pawl to effect movement of the feed wheel toward or away from the can cutting element between a can shearing position and a can release position.

A roller carried on the rock plate is moved against the shaft to lock the feed wheel in can shearing position. The spring loaded lever provides a cushioning means which increases the thrust of the feed wheel and thus improves the efficiency of the initial piercing of the can end. The cutting element is carried on a mounting plate which is retained on the can opener frame by a releasable latch.

20 Claims, 7 Drawing Figures

PUSH BUTTON OPERATED CAN OPENER

BACKGROUND AND SUMMARY OF THE INVENTION

This invention relates generally to power can openers and deals more particularly with a can opener that is wholly operated by the manipulation of push buttons.

The various advantages of push button operated can openers are recited in U.S. Pat. No. 3,611,565. The present invention is an improvement over the can opener shown in the aforementioned patent, and the primary goal of the invention is to provide a can opener of improved function, reliability, utility, and performance.

More specifically, an object of the invention is to provide a power can opener which assures the reliable piercing of a can end while reducing the possibility of the motor stalling or the can opener mechanism jamming without decreasing the conventional speed of feeding of a can while the end is being sheared therefrom. This is accomplished with an economical shaded pole electric motor of conventional power and results principally from the provision of additional gear reduction.

Another object of the invention is to provide, in a can opener of the character described, novel spring loading or cushioning means which improves the efficiency of piercing of the end of the can by the cutter wheel.

Still another object of the invention is to provide a can opener of the character described in which the cutting element is carried on a mounting plate which may be easily removed and reinstalled on the can opener frame without the use of tools.

Yet another object of the invention is to provide, in a can opener of the character described, spring loading or cushioning means which cooperates with the mechanical thrust means to assure piercing of the end of all common household food cans by the cutting element, but which is intentionally constructed so as not to effect piercing of conventional beer or soft drink cans having a thicker end. It is a particular feature of the invention that if a can having a thick end is inadvertently inserted in the can opener, the motor will not stall and the can opener mechanism will not jam, and the thick ended can can be readily ejected by simply depressing a release push button.

An additional object of the invention is to provide a can opener of the character described in which the amount of lateral movement of the can feed wheel is reduced considerably in comparison to prior art can openers.

A further object of the invention is to provide, in a can opener of the character described, an improved locking arrangement that positively locks the can feed wheel in its can shearing position until the release push button is depressed.

Another object of the invention is to provide a can opener of the character described with an internal gear of relatively large diameter which is secured to the feed wheel drive shaft in order to increase the mechanical advantage obtained during the piercing of the can end and the release of the can.

A still further object of the invention is to provide in a can opener of the character described, improved means for assuring the proper positioning of the can end piercing and release mechanism upon depression of the respective start and release push buttons of the can opener.

Other and further objects of the invention, together with the the features of novelty appurtenant thereto, will appear in the course of the following description.

DETAILED DESCRIPTION OF THE INVENTION

In the accompanying drawings, which form a part of the specification and are to be read in conjunction therewith, and in which like reference numerals are employed to indicate like parts in the various views.

Figure 1:
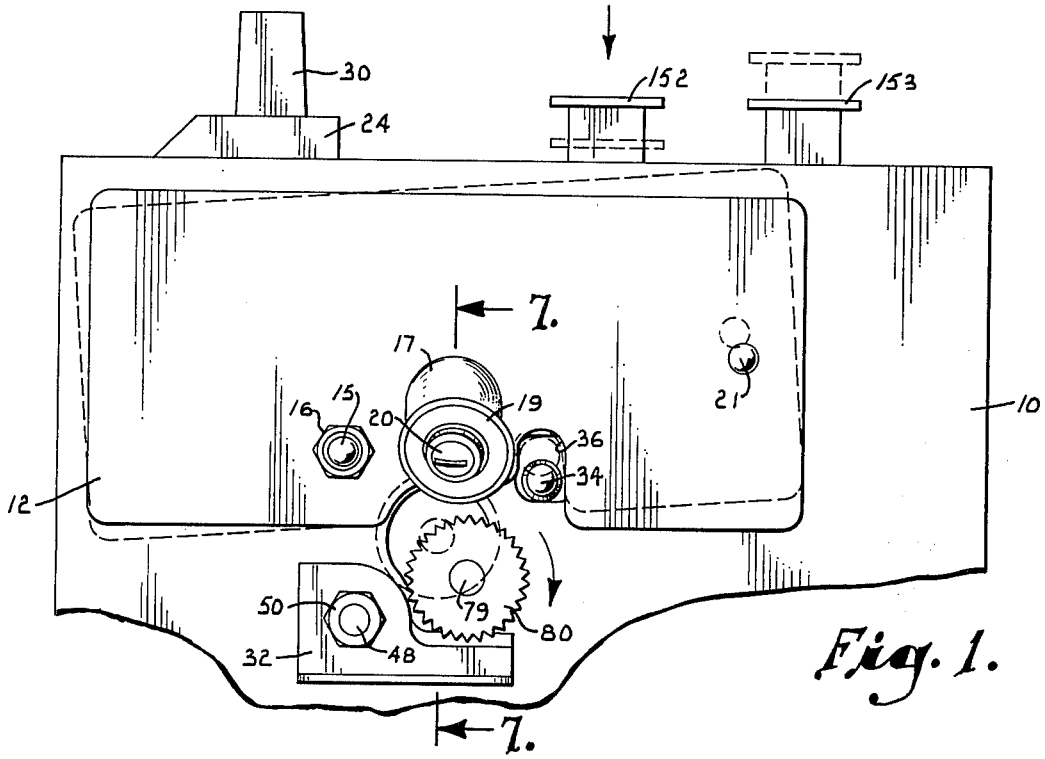
FIG. 1 is a front elevational view of the upper portion of a can opener constructed according to the invention, the broken lines indicating movement of the push buttons and cutter mounting plate during operation of the can opener.

Referring to the drawings in more detail, numeral 10 generally designates the upright frame of a can opener constructed according to the invention. Frame 10 is preferably a zinc die casting, and the usual box-like casing (not shown) cooperates with the frame to house most of the operating components of the can opener. For decorative purposes it is contemplated that a plastic cover (not shown) may be mounted on the front side of frame 10.

Four bosses 11 (FIG. 2) are molded integrally with frame 10 on the front side thereof to serve as pads for a cutter mounting plate 12. A bore 13 (FIG. 2) is formed through the frame to receive a stud 14 (FIG. 4) which extends rearwardly from the cutter mounting plate 12 to removably mount the same of the frame. Bore 11 is located within the perimeter defined by the four bosses 11.

A can gxide 15 which is a forward coaxial extension of stud 14 is fit through a hole in mounting plate 12 and extends well forwardly of the mounting plate. A nut 16 is threaded onto can guide 15 to secure the can guide to the cutter mounting plate 12.

An angled boss 17 of cutter mounting plate 12 has a stud 18 secured thereto, perferably by hotheading process. Cutter wheel 19 is mounted on stud 18 for rotative and limited wobble movement. Washerhead screw 20 secures cutter wheel 19 on stud 18. A tapered end stud 21 is anchored to extend rearwardly from cutter mounting plate 12 near the right end thereof as viewed in FIG. 1. Frame 10 is provided with a suitable opening 22 of generally rectangular configuration through which stud 21 extends when plate 12 is mounted on the frame. The height of opening 22 is greater than the diameter of stud 21 to permit limited vertical movement of the stud therein. Plate 12 is thus permitted to pivot about stud 14 between a horizontal position and a position approximately 3° counterclockwise from horizontal (broken lines in FIG. 1), the movement of plate 12 being limited to these positions by the engagement of stud 21 with the lower and upper edges of opening 22.

Figure 3:
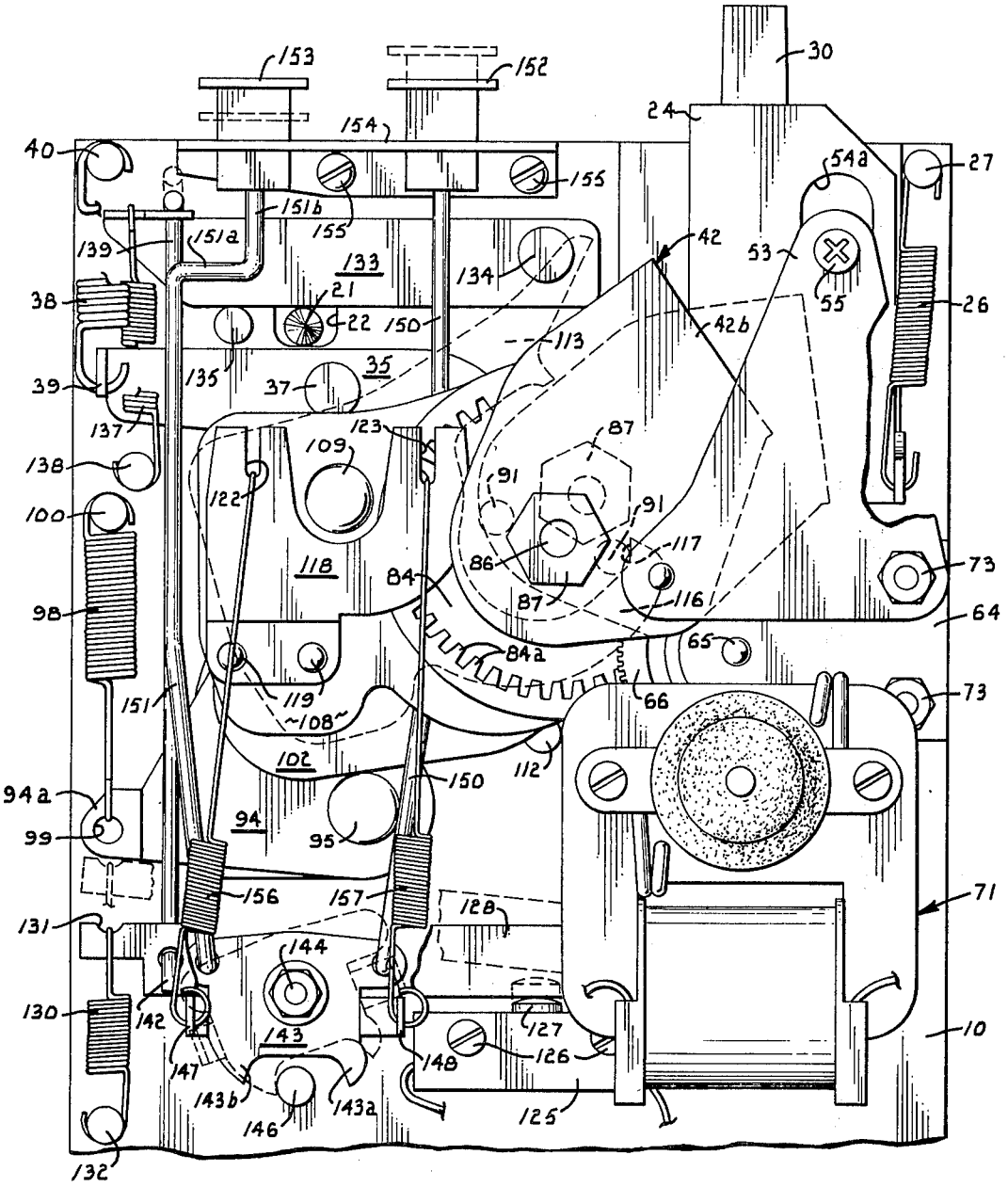
FIG. 3 is a rear elevational view of the can opener with he solid lines showing the various parts in their rest positions and the broken lines indicating the parts in position to effect release of a can.
Figure 4:
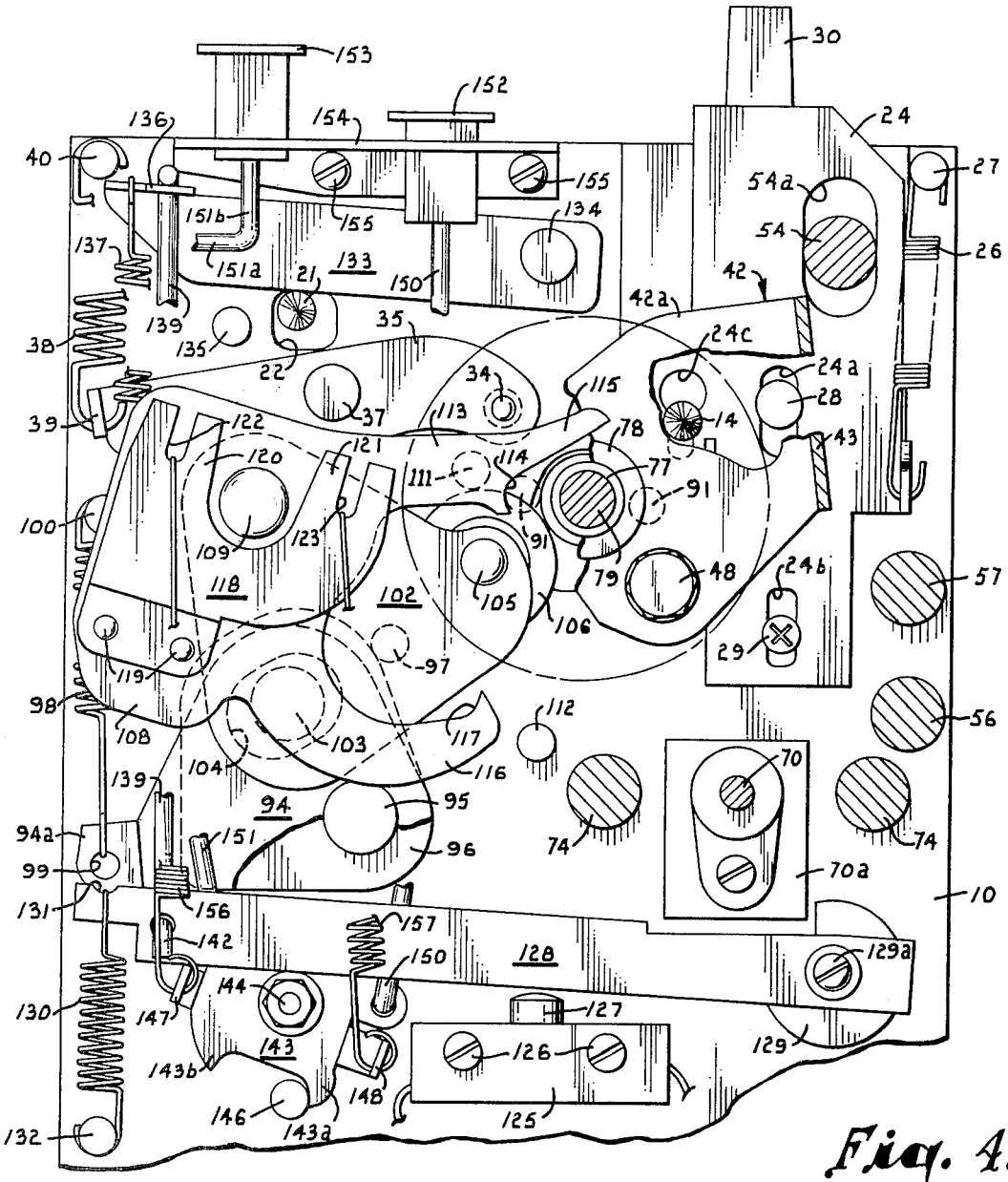
FIG. 4 is a rear elevational view similar to FIG. 3 but showing the parts in can shearing position, with various portions broken away for clarity.
Figure 5:
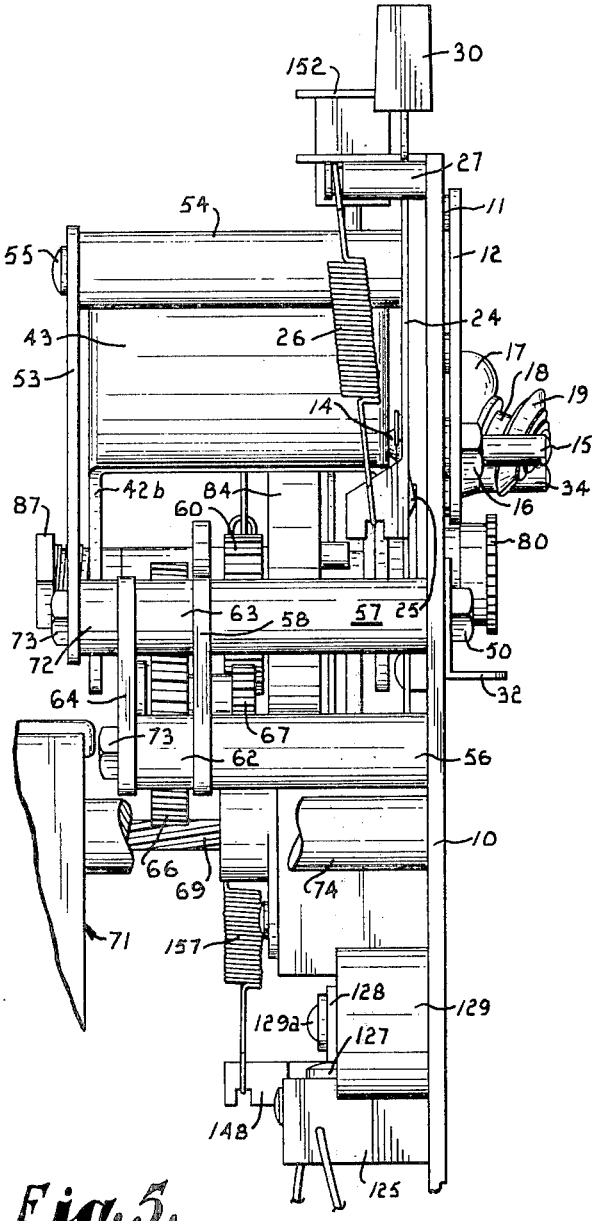
FIG. 5 is a side elevational view taken from the left side of FIG. 1.

When mounted on the can opener frame, cutter mounting plate 12 is drawn against bosses 11 by a latch 24 which is provided with rise cams 25 (FIG. 5). Latch 24 is constructed generally the same as the latches shown in U.S. Pat. Nos. 3,496,635 and 3,520,056. As described in these patents and illustrated in FIGS. 3 and 4, a tension spring 26 is hooked at its lower end in a rearwardly turned ear of latch 24 and is hooked at its upper end on a boss 27 that extends rearwardly from the back surface of frame 10. Latch 24 is fastened to frame 10 for limited wobble movement by a shoulder stud 28 and a shoulder screw 29, which are vertically spaced. As shown in FIG. 4, stud 28 extends through a vertically oriented, oval opening 24*a* formed in the latch, while screw 29 extends through a vertically oriented opening 24*b* formed in the latch at a location below opening 24*a*. Accordingly, the depression of knob 30 which extends from the latch exteriorly of the can opener casing will move latch 24 downwardly which will position the large diameter portion of a keyhole shaped opening 24*c* in registration with stud 14, and the cutter mounting plate may then be removed from frame 10. Stud 14 is preferably provided with an annular notch (not shown) which registers with the narrow slot portion of opening 24*c* to retain cutter mounting plate 12 on the can opener frame.

Figure 2:
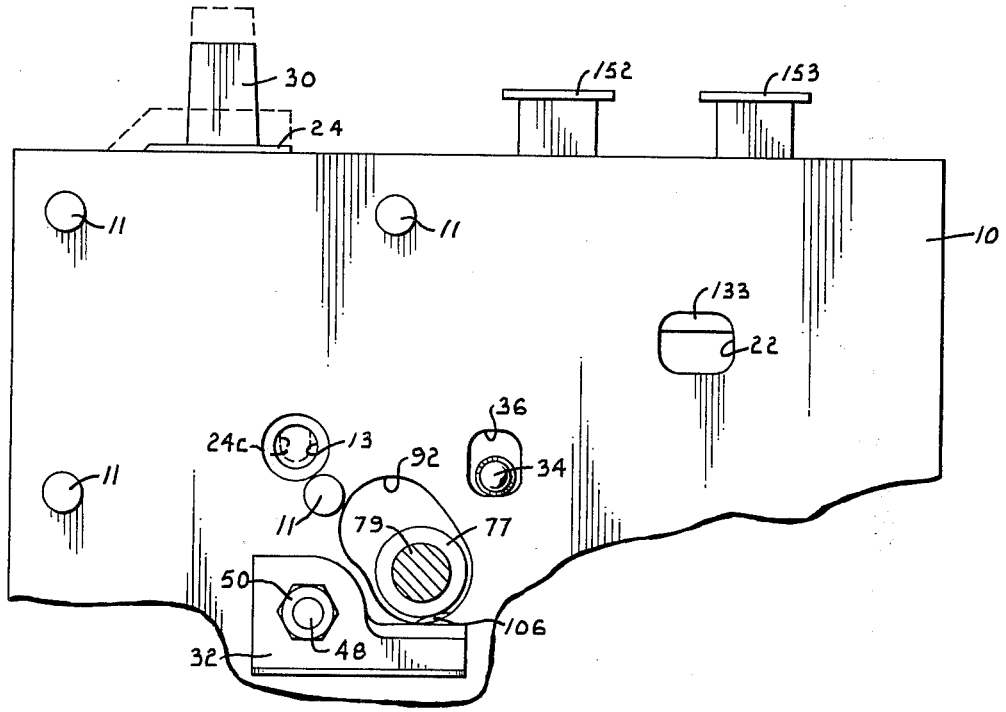
FIG. 2 is a front elevational view similar to FIG. 1 but with the cutter mounting plate removed from the can opener frame, the broken lines indicating movement of the latch to release the cutter mounting plate.

With reference to FIGS. 1 and 2, a suitable can rest 32 which may be either a separate part or integral with frame 10, extends forwardly from the frame to maintain the side walls of a can at the desired predetermined angle. If formed as a separate part from frame 10, can rest 32 has an extrusion that extends into a suitable hole of frame 10 to assist in properly aligning the can rest and retaining it against rotation.

Figure 6:
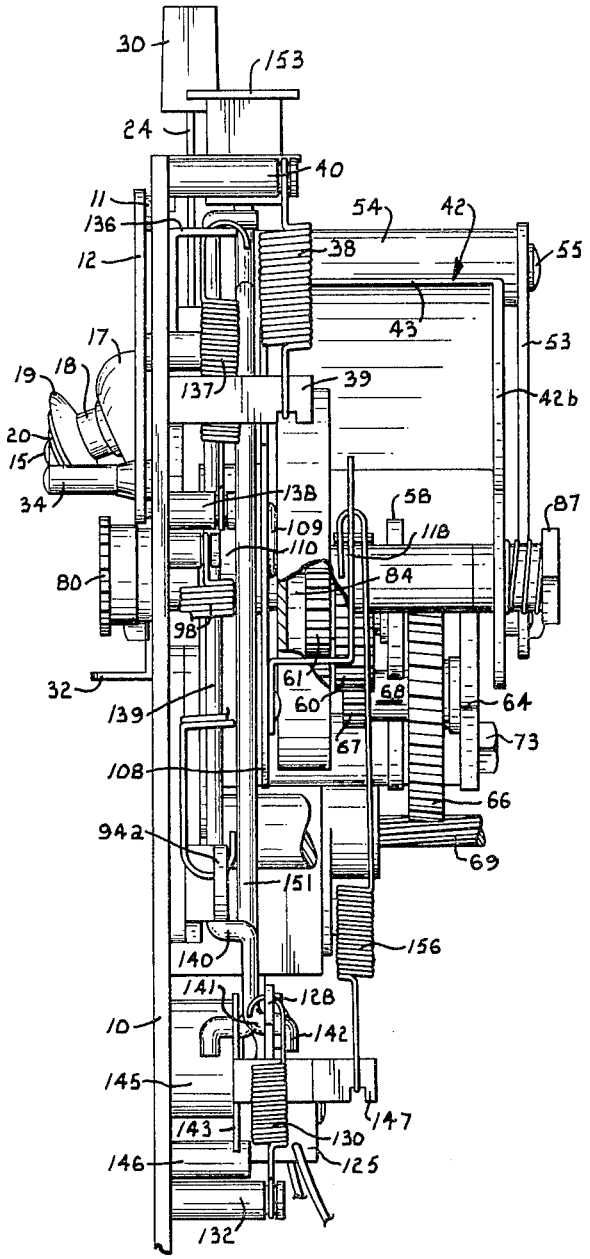
FIG. 6 is a side elevational view taken from the right side of FIG. 1.

A movable, spring urged can guide 34 is located to the right of can guide 15 and cooperates therewith during operation of the can opener. Can guide 34 is anchored in a lever 35 (preferably by hotheading process) and extends through an opening 36 in the frame. Can guide 34 projects well forwardly of the frame, as shown in FIG. 6. The lower edge of opening 36 limits the downward movement of can guide 34. Intermediate its ends, lever 35 is pivoted to frame 10 for limited movement by a shoulder stud 37 (FIGS. 3 and 4). The lower end of a tension spring 38 is hooked to a rearwardly turned leg 39 at the left end of lever 35, and the top end of spring 38 is hooked on a boss 40 of frame 10.

Figure 7:
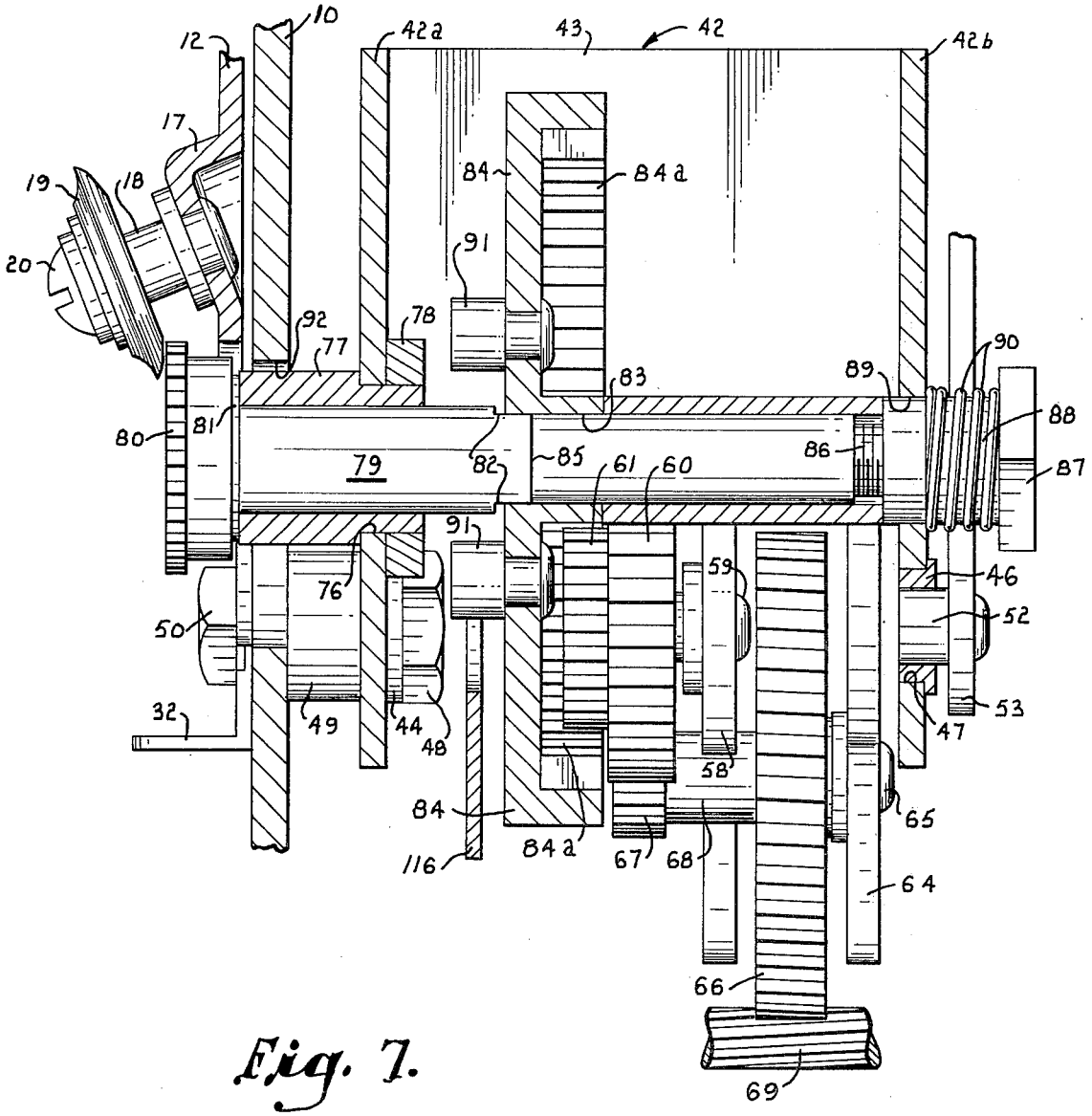
FIG. 7 is a fragmentary sectional view on an enlarged scale taken generally along line 7—7 of FIG. 1 in the direction of the arrows.

A yoke 42 is constructed and mounted in generally the same manner as the yoke shown in U.S. Pat. No. 3,611,565. Yoke 42 has a forward leg 42*a* and a rearward leg 42*b* which are interconnected by a web portion 43. With reference to FIG. 7 in particular, a hardened bushing 44 is press fitted in a hole formed in leg 42*a*, and another hardened bushing 46 is press fitted in a hole 47 formed in leg 42*b*.

A bolt 48 having three different diameters is used to securely fasten the forward leg 42*a* of the yoke to frame 10 for pivotal movement. The largest diameter portion of bolt 48 extends through bushing 44, and the intermediate diameter portion of bolt 48 extends through a spacer 49 which is interposed between frame 10 and bushing 44. The intermediate portion of bolt 48 further extends through a hole in frame 10, and the smallest diameter portion of the bolt is threaded in order to receive a nut 50 which secures the bolt to frame 10. A hardened stud 52 which is coaxial with bolt 48 is anchored in a plate 53 and extends into the bushing 46 of leg 42*b*. The upper portion of plate 53 is supported on the rear end of a cylindrical boss 54 (FIG. 5) which extends integrally from frame 10. A screw 55 fastens plate 53 to the rear end of boss 54. As best illustrated in FIGS. 3 and 4, boss 54 extends through an elliptical opening 54*a* in latch 24 to permit the latch to move as required.

A lower cylindrical boss 56 and an upper cylindrical boss 57 are cast integral with frame 10 and extend rearwardly therefrom one above the other as shown in FIG. 5. The rearward ends of bosses 56 and 57 are provided with tenon portions. and the bosses are also tapped to receive assembly screws. A plate 58 is fit over the tenon portions of bosses 56 and 57 and is thus mounted a spaced distance rearwardly of frame 10 and paralle thereto. A shoulder stud 59 (FIG. 7) is anchored in plate 58 to extend forwardly thereof, preferably by hotheading process. Referring again to FIG. 7, a combination gear 60 and smaller pinion 61 are journaled for rotation on stud 59. A cylindrical spacer 62 (FIG. 5) which forms a rearward extension of boss 56 has a tenon portion at its forward end which is extended into a suitable opening in plate 58. A similar spacer 63 forming a rearward extension of boss 57 has a forward tenon portion which is likewise fit through plate 58. Spacers 62 and 63 have tenons at their rearward ends on which a plate 64 is fit. Plate 64 is parallel to plate 58 and is located a short distance rearwardly thereof. A shoulder stud 65 (FIG. 7) is anchored in plate 64, preferably by hotheading process. A combination gear 66 and a smaller pinion 67 are journaled for rotation on stud 65, with a shaft 68 extending between gear 66 and pinion 67. Gear 66 is in mesh with and driven by a pinion 69 on the output drive shaft 70 of an electric motor 71. As shown in FIG. 4, shaft 70 is supported for rotation at its forward end in a boss 70*a* of frame 10. Pinion 67 is in mesh with gear 60 to drive the same.

With reference to FIG. 5, a spacer 72 has a forward tenon portion which is fit in a suitable opening in plate 64. A rearward tenon portion of spacer 72 extends through a hole of plate 53. Screws 73 are threaded into spacers 62 and 72 to secure plates 53, 58 and 64 and the various spacers to bosses 56 and 57. The motor 71 is mounted on the rearward ends of bosses 74 that extend rearwardly from frame 10.

With reference to FIG. 7, the forward yoke leg 42*a* is provided with an opening 76 in which a hardened shoulder bearing 77 is press fit. A collar 78 is press fitted on the smaller diameter rearward portion of bearing 77. A feed wheel drive shaft 79 extends through bearing 77. A serrated feed wheel 80 is threaded onto the forward threaded end of shaft 79, with a suitable spacer washer 81 beiing interposed between feed wheel 80 and the forward end of bearing 77.

Intermediate its ends, drive shaft 79 is provided with flats 82 for engagement with a rectangular recess 83 formed centrally in an internal gear 84. Gear 84 is provided with internal teeth 84*a* which are in mesh with the teeth of pinion 61. Shaft 79 is of reduced diameter rearwardly from a shoulder 85, and the extreme rearward end of the drive shaft is further reduced in diameter and threaded at 86. Shoulder 85 seats in the bottom of the rectangular recess 83 of the internal gear 84. A nut 87 includes a cylindrical journal portion 88 that extends through a bearing opening 89 of the rear yoke leg 42*b*. Nut 87 is threaded onto the reduced diameter portion 86 of the drive shaft 79 in order to secure gear 84 on the drive shaft. Pinion 61 is in mesh with the internal teeth 84*a* of gear 84 in order to drive the internal gear. A compression spring 90 is telescoped over the journal portion 88 of nut 87 and acts against nut 87 at one end and against yoke leg 42*b* at the other end.

A pair of hardened shoulder studs or pins 91 are anchored in the internal gear 84, preferably by hot-heading process. Pins 91 are spaced a short distance outwardly of shaft 79 at diametrically opposed positions on gear 84, and the pins project forwardly of gear 84.

An arcuate slot 92 is formed through frame 10. The larger diameter portion of bearing 77 extends through slot 92 and is able to move the length thereof in order to vary the position of feed wheel 80 on the frame. Slot 92 is oriented at a slight angle from vertical, as best shown in FIG. 2.

A spring loaded lever 94 is pivoted for limited clockwise rotation (as viewed in FIG. 3) on a headed shoulder sleeve 95. An intermediate diameter portion of sleeve 95 fits through a hole of lever 94, and the smallest diameter portion of sleeve 95 extends into a hole formed in a boss 96 (FIG. 4) which is cast integral with frame 10. A bolt (not shown) extends through frame 10 and is threaded into sleeve 95 to secure the sleeve to the frame. Clockwise rotation of lever 94 (as viewed in FIG. 4) is limited by engagement of the lever with a stop boss 97 which is integral with frame 10. The lower end of a tension spring 98 is hooked in a hole 99 which is formed in a rearwardly turned left end portion 94*a* of lever 94. The top end of spring 98 is hooked on a boss 100 that is integral with frame 10.

A rock plate 102 is pivoted to lever 94 by a shoulder rivet 103 (FIG. 4). An intermediate diameter portion of rivet 103 extends through a hole in lever 94, while the smallest diameter portion of the rivet extends through rock plate 102 to which it is securely riveted. A suitable clearance slot 104 (FIG. 4) is provided in boss 96 to accommodate the head of shoulder rivet 103 as lever 94 pivots on the frame.

With continued reference to FIG. 4, a hardened shoulder stud 105 is anchored to extend forwardly from rock plate 102 at the upper right portion thereof. A disc-shaped hardened roller 106 is journaled for rotation on stud 105. Roller 106 bears against the rear surface of frame 10 in low friction contact therewith.

A two-legged pawl 108 is pivoted to rock plate 102 rearwardly thereof by a shoulder rivet 109. A suitable spacer 110 (FIG. 6) is interposed between rock plate 102 and pawl 108 to space the pawl rearwardly of the rock plate. An upper stop boss 111 and a lower stop boss 112 (FIG. 4) are integral with frame 10 at positions to engage roller 106 in order to positively limit the rotation of rock plate 102 in both pivotal directions.

Pawl 108 has an upper leg 113 in the end of which a notch 114 is formed. Leg 113 is further provided with an extension 115 which extends above notch 114 generally upwardly and to the right. A lower leg 116 of the pawl is spaced below leg 113 and is provided with a notch 117 in its end. To substantially counterbalance pawl 108 about its pivot axis 109, a portion of the pawl extends to the left of the shoulder rivet 109. Pawl 108 is mounted with its legs 113 and 116 located in close proximity to the forward surface of gear 84 in order to engage pins 91, as will be described in more detail.

A bracket 118 is secured to pawl 108 by a pair of rivets 119. Bracket 118 includes a left leg 120 and a right leg 121 which are spaced rearwardly from the pawl and laterally from one another to project upwardly on opposite sides of shoulder rivet 109. A notch 122 is formed in the top end of leg 120, while a notch 123 is formed in the top end of leg 121. Notch 123 preferably extends lower than notch 122.

Referring to FIGS. 3 and 4, a conventional switch 125 is mounted on frame 10 near the bottom thereof by a pair of screws 126. Switch 125 includes a plunger 127 which is biased inside the switch in order to be urged upwardly at all times. Switch 125 is in series with the electric motor 71 and is of the normally closed on "on" type unless plunger is depressed. The depression of plunger 127 opens switch 125 and deenergizes motor 71.

An elongate lever 128 which is generally horizontal is pivoted to a boss 129 (FIG. 4) which is integral with frame 10 by a hsoulder screw 120*a* located at the right end of lever 128 as viewed in FIG. 4. Lever 128 is in engagement with plunger 172 of switch 125 when the parts are in their rest positions. The upper end of a tension spring 130 is hooked in a notch 131 formed in the left end of lever 128, and the lower end of spring 130 is hooked on a boss 132 that is integral with frame 10. Spring 130 is of sufficient tension to maintain plunger 127 depressed in order to maintaiin switch 125 in the "off" condition unless a sufficient external force is applied to lever 128.

A generally horizontal lever 133 is pivoted near its right end (FIGS. 3 and 4) at a location near the top of frame 10 by a shoulder screw 134. Counterclockwise rotation of lever 133 is limited by engagement of its lower edge with a stop boss 135 which is integral with frame 10. At its left end, lever 133 has a rearwardly turned flange 136 in which the top end of a tension spring 137 is hooked. The lower end of spring 137 is hooked on a boss 138 that is integral with frame 10.

A switch control rod 139 has its upper end bent rearwardly and inserted in an opening in flange 136. Rod 139 extends generally vertically throughout most of the height of frame 10, and its lower portion is bent rearwardly at 140 and again at 141, as best shown in FIG. 6. The lower end of rod 139 is bent downwardly at 142 from the lower bend 141, and the lower end of the rod is pivoted in a hole formed near the left end (as viewed in FIGS. 3 and 4) of lever 128.

A switch control lever 143 is pivoted by a shoulder screw 144 to a boss 145 (FIG. 6) that is integral with frame 10 at a location below lever 128. As shown in FIGS. 3 and 4, lever 143 is provided with a pair of laterally spaced projections 143*a* and 143*b* which engage a stop boss 146 of frame 10 to limit the pivotal movement of lever 143 in both directions. Lever 143 includes a pair of laterally spaced, rearwardly turned legs 147 and 148 at its left and right sides, respectively. When lever 128 is in its horizontal position, its under edge seats downwardly on legs 147 and 148, as shown in solid lines in FIG. 3.

A "start" switch control rod 150 includes an offset lower end which is pivoted in a hole formed near the right edge of switch control lever 143, as best shown in FIG. 4. A "release" switch control rod 151 is likewise offset at its lower end which is pivoted in a hole formed near the left edge of lever 143, as best shown in FIG. 3. Rods 150 and 151 extend generally vertically throughout substantially the entire height of the can opener frame. Near its upper end, control rod 151 is bent horizontally at 151*a* and vertically again at 151*b*. A push button 152 is press fitted on the top end of rod 150, and a similar push button 153 is press fitted on the upper end of rod 151. Push buttons 152 and 153 extend freely through suitable openings formed in a bracket 154 that is either fastened to frame 10 by screws 155 or is in the form of a flange integral with the can opener frame. Push buttons 152 and 153 are accessible from the exterior of the can opener frame.

The tension spring 156 has a looped lower end which is positioned in a notch formed in leg 147 of lever 143, while the upper end of spring 156 is hooked in slot 122 of the left leg 120 of bracket 118. In a similar manner, the lower end of a tension spring 157 is looped in a notch formed in leg 148 of lever 143, and the top end of spring 157 is hooked in the notch 123 formed in the right leg 121 of bracket 118. Springs 156 and 157 are preferably of equal free length.

In operation, the normal cycle of the opening of a can will have left feed wheel 80 in its lowermost position. However, if feed wheel 80 is not in its lower position, it may be moved thereto by depressing the release push button 153 and maintaining same in its depressed condition until the feed wheel moves to the position shown in FIG. 1. This position is also illustrated in solid lines in FIG. 3, where roller 106 is in engagement with stop boss 112, rock plate 102 is in its extreme clockwise position (as viewed in FIGS. 3 and 4), and the free end of the upper pawl leg 113 is located above the feed wheel drive shaft 79. A can to be opened is inserted in the usual manner with its lid held upwardly against the periphery of cutter wheel 19.

When the start push button 152 is then fully depressed, the lower end of control rod 150 pushes leg 148 of lever 143 downwardly, which pivots lever 143 clockwise to the position shown in FIG. 4. The resulting upward movement of the other lever leg 147 lifts lever 128 above plunger 127, and switch 125 is thus immediately turned on. Motor 71 begins to rotate feed wheel 80 through the reduction gears.

Simultaneously, the downward movement of lever leg 148 places spring 157 under increased tension, and pawl 108 is pivoted clockwise about shoulder rivet 109 until the upper pawl leg 113 is moved downwardly on top of feed wheel drive shaft 79. If either of the pins 91 is positioned at the time to interfere with the full movement of pawl leg 113 into engagement with shaft 79, this pin 91 will shortly orbit out of interfering position until spring 157 is able to move leg 113 fully downwardly on top of shaft 79. The extension 115 of leg 113 assures that pawl 108 will not pivot further than intended.

The counterclockwise rotation of gear 84 carries one of the pins 91 around until it becomes engaged in notch 114 of pawl leg 113. Once this occurs, continued rotation of gear 84 causes the engaged pin 91 to fulcrum in notch 114 and raises drive shaft 79 from its lower position towards its upper position. At the same time, the leftward force on pawl leg 113 pushes the pawl to the left which pivots rock plate 102 counterclockwise about shoulder rivet 103. Accordingly, roller 106 moves upwardly toward the position shown in FIG. 4, wherein shaft 79 is in its upper position and roller 106 is engaged against bearing 77 to lock feed wheel 80 in place.

The thrust for effecting the piercing of the can lid is obtained by the straightening of a toggle, one link of which comprises the distance of the engaged pin 91 from the axis of shaft 79 and the other link of which comprises the distance of pin 91 from the axis of the shoulder rivet 109 on which pawl 108 is pivoted. This toggle is fully straightened when the parts are in the position shown in FIG. 4, and the straightening occurs before roller 106 engages stop boss 111. It is noted that the stud 105 on which roller 106 is journaled is located on a straight line extending between shoulder rivet 103 and the axis of shaft 79, or slightly above such a line. The downward force exerted on feed wheel 80 by the engaged can acts on rock plate 102 through roller 106, and because of the position of the roller, this force cannot pivot the rock plate clockwise about its shoulder rivet 103. Rock plate 102 and roller 106 are thus maintained rigidly in place to oppose the downward force on feed wheel 80, and such downward force cannot pivot yoke 42 about its coaxial pivot points, bolt 48 and stud 52.

Immediately before the can lid is pierced as the aforementioned toggle straightens, the counterclockwise force exerted on lever 94 by rock plate 102 pivots the lever slightly as shown in FIG. 4, and this movement of lever 94 places spring 98 under increased tension. The tension that builds up in spring 98 pivots lever 94 back (clockwise) against its stop boss 97 as the toggle straightens out, and this results in a cushioning effect whereby the force of spring 98 is added to the piercing thrust of the toggle. Accordingly, the efficiency of the piercing of the can lid is increased and less motive power is required to pierce the can than would be the case in the absence of a cushioning means.

As the can lid is being sheared, the force of spring 38 urges can guide 34 downwardly against the rim of the engaged can, and the two can guides 15 and 34 thus cooperate to maintain the can rim in proper traction with respect to feed wheel 80. Feed wheel 80 and shaft 79, along with all parts secured thereto, are urged rearwardly at all times by the force of spring 90, while cutter mounting plate 12 is drawn against bosses 11 by latch 24 and the rise cams 25 thereof. The side wall of the engaged can is maintained at the proper angle relative to the face of feed wheel 80 by the can rest 32. As cutter wheel 19 shears the lid of the can, it is normally in the position shown in FIG. 7, but is free to wobble when necessary, such as when the thick side seam of the can is passing between the overlapping portions of cutter wheel 19 and feed wheel 80.

After the can lid has been initially pierced, push button 152 may be released since the motor 71 will remain on until the can lid has been completely sheared. The resistance of the can to shear by cutter wheel 19 pivots cutter mounting plate 12 counterclockwise about stud 14 to the position shown in broken lines in FIG. 1. As shown in FIG. 4, this pivotal movement of plate 12 carries stud 21 upwardly in opening 22 which pivots lever 133 upwardly about shoulder screw 134 against the force of spring 137. This pivoting of lever 133 moves rod 139 upwardly, and the lower end of the rod maintains the left end of lever 138 in its upper position, even after push button 152 is released. Accordingly, lever 128 is held above plunger 127 throughout the shearing of the can lid. Motor 71 thus remains on until the can shearing has been completed, at which time the resistance of the can to shear is no longer present. Spring 137 then pulls lever 133 downwardly and rod 139 permits spring 130 to return lever 128 to its horizontal position wherein it depresses plunger 127. As a result, motor 71 is automatically deenergized upon completion of the can shearing.

After the can lid has been completely sheared and the motor has automatically been turned off, feed wheel 80 remains in its upper position and cooperates with cutter wheel 19 to retain the can in the can opener. To release the can, the release push button 153 is fully depressed. This pushes rod 151 downwardly and the lower end of rod 151 pivots lever 143 counterclockwise about its shoulder screw 144 to the broken line position of FIG. 3. Leg 148 of lever 143 acts against the under edge of lever 128 to pivot same upwardly, and plunger 127 is thereby released to energize motor 71.

The downward movement of leg 147 places spring 156 under increased tension, and this spring pivots pawl 108 counterclockwise about its shoulder rivet 109. The free end of the lower pawl leg 116 is thus moved against the under side of shaft 79. If one of the pins 91 is in position to interfere with the full movement of leg 116 against the shaft, the pin will soon orbit out of interfering position to permit leg 116 to then move against shaft 79.

The counterclockwise rotation (FIG. 3) of gear 84 carries one of the pins 91 around until it becomes engaged in notch 117 of leg 116. Further rotation of gear 84 causes the engaged pin 91 to fulcrum in notch 117, and pawl 108 is pulled to the right due to the force of the engaged pin 91 on leg 116. This pivots rock plate 102 clockwise about shoulder rivet 103 which carries roller 106 downwardly away from bearing 77. Continued rotation of gear 84 results in pawl leg 16 pulling the engaged pin 91 to the left, and this in turn pivots yoke 42 counterclockwise to the solid line position of FIG. 3 wherein feed wheel 80 is located in its lower position. The can is thus released from engagement between feed wheel 80 and cutter wheel 19 for removal from the can opener. The release of push button 153 then permits lever 128 to be lowered under the action of spring 130 until lever 128 depresses plunger 27 to shut motor 71 off. It is noted that when yoke 42 is in the solid line position of FIG. 3, the toggle consisting of the distance from the engaged pin 91 to the axis of shaft 79 plus the distance from shaft 79 to the axis of shoulder rivet 109 is substantially straight.

The removal of cutter mounting plate 12 from frame 10 for cleaning of cutter wheel 19 or other purposes is easily accomplished by depressing the knob 30 of latch 24 to push the latch downwardly. This positions the large diameter portion of keyhold opening 24*c* registration with stud 14 so that plate 12 can be pulled forwardly to withdraw stud 14 from frame opening 13. Plate 12 may be reinstalled by depressing knob 30, inserting stud 14 in bore 13, and releasing knob 30 so that stud 14 in engaged by latch 24 to draw plate 12 against bosses 11.

No damage will result to the can opener if either push button 152 or 153 is depressed longer than necessary because the pins 91 are able to ride in and out of pawl leg notches 114 and 117 in ratcheting fashion. Therefore, if the can opener is provided with cutlery sharpening means driven by motor 71, either push button 152 or 153 may be depressed for as long as desired to operate the cutlery s sharpener.

As previously suggested, notch 123 preferably extends somewhat lower than notch 122. However, the two tension springs 156 and 157 are of equal length, and there will thus be some lash in one of the springs when the parts are in their rest positions or when either push button 152 or 153 is depressed. The lash facilitates the proper pivotal movement of pawl 108 when either push button is depressed and assures that the pawl will pivot as intended.

Spring 98 is selected such that its force is sufficient to cause piercing of common household cans while being insufficient to effect piercing of beer or soft drink cans which have ends approximately 50% thicker than other household cans. If a can with an unduly thick end is inadvertently inserted in the can opener, the force of spring 98 (which will be stretched in the position of FIG. 4) will not return lever 94 to its extreme clockwise position against boss 97, and feed wheel 80 will thus not be forced to its uppermost position. consequently, the can will not be pierced but feed wheel 80 will feed it with respect to cutter wheel 19 so that the mechanism will not jam and motor 71 will not stall.

As best illustrated in FIG. 3, the shaft 79 for feed wheel 80 moves between positions approximately 25° above horizontal to approximately 45° above horizontal with respect to the pivot axis of yoke 42 during operation of the can opener. Therefore, the lateral movement of feed wheel 80 is limited to a short distance and it is unnecessary to provide means for accommodating substantial lateral movement of the feed wheel. It is further pointed out that the provision of a large internally toothed gear 84 improves the mechanical advantage obtained when moving feed wheel 80 between its upper and lower positions because pinion 61 is able to apply driving force to gear 84 at a substantial distance from the axis of either pin 91 as the pins fulcrum in either of the notches 114 or 117 to accomplish movement of the feed wheel.

From the foregoing, it will be seen that this invention is one well adapted to attain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. A can opener comprising:

a frame;

a cutting element for shearing a can;

means for mounting said cutting element on said frame;

a rotatable shaft;

a feed wheel carried on said shaft to feed a can with respect to said cutting element;

a carrier member supporting said shaft for rotation, said carrier member being supported for pivotal movement on said frame at a location offset from said shaft to carry said feed wheel toward and away from said cutting element between an upper can shearing position and a lower can release position;

a motor;

means drivingly coupling said motor to said shaft;

a pin coupled with said shaft outwardly of the axis thereof for orbital movement about the shaft axis;

a rock plate supported on said frame for pivotal movement about a pivot coupling;

a pawl coupled to said rock plate at a location offset from said pivot coupling, said pawl including a pin engaging portion engageable with said pin to pivot said carrier member in a direction to locate said feed wheel in can shearing position;

means for operating said pawl to position said pin engaging portion thereof in engagement with said pin; and a lock member coupled with said rock plate at a location offset from said pivot coupling to move toward and away from said shaft upon pivotal movement of said rock plate, the engagement of said pin engaging pawl portion with said pin effecting pivotal movement of said rock plate in a direction carrying said lock member against said shaft to lock said feed wheel in can shearing position.

2. A can opener as set forth in claim 1, wherein said means includes:

a push button; and linkage interconnecting said push button with said pawl in a manner to position said pin engaging pawl portion in engagement with said pin upon depression of said push button.

3. A can opener as set forth in claim 2, including switch means for energizing and deenergizing said motor, said linkage actuating said switch means to energize said motor upon depression of said push button.

4. A can opener as set forth in claim 3, including means for retaining said linkage in position to maintain said switch means actuated during shearing of a can by said cutting element.

5. A can opener as set forth in claim 4, including means for shifting said linkage to permit said switch means to deenergize said motor automatically upon completion of the shearing of a can by said cutting element.

6. A can opener as set forth in claim 1, wherein said cutting element mounting means includes a mounting plate and means supporting said mounting plate on said frame for pivotal movement about a pivot axis, said cutting element being supported on said mounting plate at a location offset from said pivot axis to effect pivotal movement of said m mounting plate to a preselected position as a can is being sheared by said cutting element.

7. A can opener as set forth in claim 6, including:

a lever supported on said frame for pivotal movement;

a pin member extending from said mounting plate at a location offset from said pivot axis, said pin member engaging said lever to pivot same upon movement of said mounting late to said preselected position; and switch means for energizing and de-energizing said motor, said switch means being operable in response to pivoting of said lever to maintain said motor energized.

8. A can opener as set forth in claim 7, including means for moving said lever to a position permitting said switch means to deenergize said motor automatically upon completion of the shearing of the can.

9. A can opener as set forth in claim 6, including a first can guide extending forwardly from said mounting plate and a second can guide supported on said frame to extend forwardly thereof.

10. A can opener as set forth in claim 9, including:

a link member pivoted to said frame, said second can guide extending from said link member; and means for biasing said link member in a preselected pivotal direction.

11. A can opener as set forth in claim 6, wherein the means supporting said mounting plate on said frame comprises:

a pin member extending from said mounting plate to provide said pivot axis, said frame including an opening in which said pin member is positioned to support said mounting plate on the frame; and a latch engageable with said pin member to retain said mounting plate on the frame, said latch being releasable from said pin member to permit removal of said mounting plate from said frame.

12. A can opener as set forth in claim 11, including a first can guide extending forwardly from said mounting plate at a location coaxial with said pin member, and a second can buide extending forwardly of said frame at a location offset from said mounting plate.

13. A can opener as set forth in claim 1, wherein the means coupling said motor to said shaft includes reduction gearing, said reduction gearing including a first gear coupled to be driven by said motor and a second gear of larger diameter than said first gear, said second gear being carried on said shaft and including internal teeth in meshing engagement with said first gear, said internal teeth being located a greater distance from said shaft than said pin.

14. A can opener as set forth in claim 1, including:

a second pin engaging portion on said pawl engageable with said pin to pivot said carrier member in a direction to locate said feed wheel in its release position, the engagement of said second pin engaging pawl portion with said pin effecting pivotal movement of said rock plate in a diirection carrying said lock member away from said shaft to permit movement of said feed wheel to its release position; and second means for operating said pawl to position said second pin engaging portion thereof in engagement with said pin.

15. A can opener as set forth in claim 14, wherein said second pawl operating means includes;

a push button; and linkage interconnecting said push button with said pawl in a manner to position said second pin engaging pawl portion in engagement with said pin upon depression of said push button.

16. A can opener as set forth in claim 15, including switch means for energizing and deenergizing said motor, said linkage actuating said switch means to energize said motor upon depression of said push button.

17. A can opener as set forth in claim 1, wherein said lock member comprises a roller element carried on said rock plate and bearing against said frame, said roller element being located on or above a line extending between said shaft and said pivot coupling when said feed wheel is locked in can shearing position.

18. A can opener comprising:

a frame;

a cutting element for shearing a can;

means for mounting said cutting element on said frame;

a rotatable shaft;

a feed wheel carried on said shaft to feed a can with respect to said cutting element;

a carrier member supporting said shaft for rotation, said carrier member being supported for pivotal movement on said frame at a location offset from said shaft to carry said feed wheel toward and away from said cutting element between an upper can shearing position and a lower can release positon;

a motor;

means drivingly coupling said motor to said shaft;

a pin coupled with said shaft outwardly of the axis thereof for orbital movement about the shaft axis;

a lever member pivoted to said frame for limited pivotal movement;

yieldable biasing means urging said lever member toward a stable position;

linkage connected with said lever member;

a pawl supported on said linkage for pivotal movement about a pivot coupling, said linkage permitting movement of said pivot coupling toward and away from said shaft, said pawl including a pin engaging portion engageable with said pin to pivot said carrier member in a direction to locate said feed wheel in can shearing position; and means for operating said pawl to position said pin engaging portion thereof in engagement with said pin, said linkage effecting displacement of said lever member from its stable position as said feed wheel approaches can shearing position, said biasing means returing said lever member tto its stable position as said feed wheel reaches can shearing position, thereby acting through said linkage and pawl to increase the upward thrust of said feed wheel as same reaches can shearing position.

19. A can opener as set forth in claim 18, wherein said linkage comprises a rock plate pivoted to said lever member, said pivot coupling connecting said pawl to said rock plate.

20. A can opener as set forth in claim 18, including a lock member carried on said linkage for movement therewith toward and away from said shaft, said lock member bein operable to releasably lock said feed wheel in can shearing position.

* * * * *